US005970297A

United States Patent [19]

Gross

[11] Patent Number: 5,970,297

[45] Date of Patent: Oct. 19, 1999

[54] TRANSFER APPARATUS AND METHOD FOR REMOVING RESIDUAL MATERIAL FROM A TRANSFER MEMBER

[75] Inventor: Robert A. Gross, Penfield, N.Y.

[73] Assignee: Xerox Corporation, Stamford, Conn.

[21] Appl. No.: 08/219,189

[22] Filed: Mar. 28, 1994

[51] Int. Cl.[6] ..... G03G 15/14; G03G 21/00

[52] U.S. Cl. ..... 399/313; 399/302; 399/308

[58] Field of Search ..... 355/271–273, 355/298, 296, 299; 399/313, 302, 308

[56] References Cited

U.S. PATENT DOCUMENTS

| | | | |
|---|---|---|---|
| 3,700,328 | 10/1972 | Davidge et al. . | |
| 3,781,105 | 12/1973 | Meagher | 355/3 |
| 4,588,279 | 5/1986 | Fukuchi et al. | 355/3 TR |
| 4,788,572 | 11/1988 | Slayton et al. | 355/3 TR |
| 4,947,214 | 8/1990 | Baxendell et al. | 355/274 |
| 5,107,303 | 4/1992 | Miyamoto et al. | 355/296 |
| 5,138,363 | 8/1992 | Yuge | 355/275 X |
| 5,159,390 | 10/1992 | Imaizumi | 355/212 |
| 5,196,893 | 3/1993 | Nishise et al. | 355/271 |
| 5,214,479 | 5/1993 | Lindblad et al. | 355/271 |
| 5,237,374 | 8/1993 | Ueno et al. | 355/299 |
| 5,253,023 | 10/1993 | Hosaka et al. | 355/279 |
| 5,262,832 | 11/1993 | Takeda | 355/326 R |
| 5,270,783 | 12/1993 | Bisaiji et al. | 355/246 |

*Primary Examiner*—Richard Moses
*Attorney, Agent, or Firm*—John M Kelly

[57] ABSTRACT

A system for removal of toner particles from a transfer support member surface without the necessity of an independent toner recovery system. A cleaning blade on the transfer support member collects and accumulates residual toner particles. When a non-image area on the photoconductor passes beneath the blade, the blade is spaced from the photoconductor and a reverse bias applied to the transfer support member so that the accumulated particles are transferred to the photoconductive surface. Subsequently, the cleaning system associated with the photoconductive member removes these toner particles.

34 Claims, 7 Drawing Sheets

TRANSFER APPARATUS AND METHOD FOR REMOVING RESIDUAL MATERIAL FROM A TRANSFER MEMBER

FIELD OF INVENTION

The present invention relates generally to a system and method for transfer of charged toner particles in an electrostatographic printing apparatus, and more particularly to a cleaning device and method for removing residual toner and debris from the surface of a transfer support member used for the support of a copy sheet during a transfer process, such as a biased transfer roll, an intermediate transfer belt, or an electrostatic transport belt, without the necessity of an independent toner recovery system, distinct from that found in association with the cleaning unit of the photoconductive member.

BACKGROUND OF THE INVENTION

Generally, the process of electrostatographic printing is executed by exposing a light image of an original document onto a substantially uniformly charged photoconductive member. Exposing the charged photoconductive member to a light image discharges the photoconductive surface thereon in areas corresponding to non-image areas in the original document while maintaining the charge in image areas, thereby creating an electrostatic latent image of the original document on the photoconductive member. Toner particles are subsequently deposited onto the latent image to form a toner powder image. This toner powder image is then transferred from the photoconductive member, either directly or after an intermediate transfer step, to a final support sheet. The transferred image may then be permanently fused to the sheet. In a final step, the photoconductive surface of the photoconductive member is cleaned to remove any residual developing material thereon in preparation for successive imaging cycles.

This printing process is well known and is commonly used for light lens copying of an original document. Analogous processes also exist in other electrostatographic printing applications such as, for example, ionographic printing and reproduction, where charge is deposited on a charge retentive surface in response to electronically generated or stored images. A laser beam may also be used to imagewise discharge the photoconductive member in accordance with stored electronic information.

The process of transferring toner particles from the photoconductive surface is realized at a transfer station. In a typical transfer station, transfer is achieved by applying electrostatic force fields in a transfer region sufficient to attract the toner particles from the photoconductive surface to the final support sheet or an intermediate transfer belt.

Intermediate transfer belts are used in conjunction with one (tandem) or more (non-tandem) photoconductive members for transport of a developed toner powder image to a final support sheet. For example, intermediate transfer belts are used in non-tandem applications where successive color toner powder images are individually transferred to the transfer belt where they are sequentially superimposed onto the previously transferred color toner powder image. A composite image is formed and then transferred from the transfer belt to a final support sheet. Alternatively, the composite image may be formed on the photoconductor before being transferred to an intermediate transfer belt, and then to a final support sheet. In a tandem apparatus, each of multiple photoconductive members transfers an individual color toner powder image to the intermediate transfer belt in sequential superimposed registration onto the previous color toner powder image, thereby forming a full composite image on the intermediate transfer belt.

Transfer of developed toner images between support surfaces is often accomplished by using a corona generating device. The intermediate transfer member or final support sheet, is placed in direct contact with the developed toner image on the photoconductive surface. The corona generator sprays the intermediate member or final support sheet with ions having a polarity opposite that of the toner particles, thereby transferring the toner particles from the photoconductive surface to the intermediate member or final support sheet.

Alternatively, transfer can be induced by applying a potential difference between the intermediate member or final support sheet by a biased member contacting therewith. For example, a biased transfer roll system (BTR) defines a nip with the photoconductor through which the intermediate member or final support sheet passes. The pressure and electrical field in the nip transfers the toner image from the photoconductor to the intermediate member or final support sheet.

An electrostatic transport belt is commonly used in conjunction with a corona generator. Generally, an electrostatic transport belt transports the final support sheet into and out of contact with the photoconductor at a transfer station. A corona generator for accomplishing transfer, is located behind the electrostatic transport belt. U.S. Pat. No. 3,966,199 to Silverberg discloses such a system, the relevant portions of which are hereby incorporated herein by reference. Transfer could alternatively be accomplished with a biased transfer roller, rather than a corona generator, positioned against the back side of the electrostatic transport belt.

Thus, transfer support members such as those hereinbefore described, (e.g. bias transfer roll, intermediate transfer belt, electrostatic transport belt), have in common their function of directly supporting the transfer of a developed toner powder image from a photoconductive member. Due to the varying electrostatic force fields involved in the transfer process, stray toner and debris particles may adhere to the surface of the transfer support member. Consequently, there is a need to clean the surface of the transfer support member so as to prevent degradation of the quality of subsequent copies and/or prevent toner particles from being fused to the backside of the final support sheet. Typical cleaning methods include wiping with a brush, a web, a blade and the like, a magnetic brush, air flow, or a combination of these. All of these, alone or in combination, require that collected residual toner and debris be removed from the cleaning device.

Thus, it is necessary to clean this residual material from the transfer support member surface with a cleaning system separate from the cleaning system used to clean the photoconductor.

The following disclosures may be relevant to various aspects of the present invention.

U.S. Pat. No. 3,781,105 to Meagher discloses a biasing transfer roller for electrostatic transfer of charged particles to a transfer member using constant current control of the bias voltage supply in a transfer roller system, rather than constant voltage control. A cleaning brush with its associated vacuum housing is described as positioned adjacent to the bias transfer roller to clean stray toner and dirt from the outer surface of the roller.

U.S. Pat. No. 5,214,479 to Lindblad et al. discloses a cleaning apparatus for cleaning residual toner and paper fiber residue from a biased transfer roll using high velocity air and substantially contactless flexible biased conductive shims. The air flow created evacuates the air with debris particles therein through a vacuum chamber, where a filter collects the residue which is then deposited in a filter bag.

U.S. Pat. No. 5,237,374 to Ueno et al. discloses a second cleaning blade for cleaning residual toner from the intermediate transfer body, with a contact pressure applied to the intermediate transfer body being larger than that applied by a first cleaning blade to the photoconductive body.

U.S. Pat. No. 4,588,279 to Fukuchi et al. discloses a cleaning roller rotating in contact with an intermediate transfer member, wherein the cleaning roller uses a structure such that the outer layer consists of a porous or fibrous substrate and is covered with toner or a resin identical or compatible with the toner. The toner sticking to the cleaning roller member is removed by being scraped by a blade at a stage when it has become substantially hardened on the roller. Periodic replacement of the cleaning roller is also described as an option for removal of accumulated toner.

U.S. Pat. No. 4,788,572 to Slayton et al. discloses a transfer belt which rotates with photoconductor belt whereby a cleaning knife disengages with the transfer belt during the cycles when toner is building an image onto the intermediate transfer belt, and engages with the transfer belt after the toner image has been transferred from the transfer belt, for removal of residual toner. The cleaning knife disengages with the transfer belt at a defined seam area so that the "streak" of toner from disengaging action is left on the transfer belt outside of the imaging area of the photoconductor belt. Slayton et al. describes a receptacle bin for collection of residual toner particles scraped from the transfer belt by the knife, which fall into the receptacle by gravity.

U.S. Pat. No. 5,253,023 to Hosaka et al. may also be found to be relevant to the present invention. Hosaka discloses an electrostatographic apparatus wherein transferring and fixing of the toner image onto a transfer material is performed simultaneously using a heating means and a soft roller transfer unit. In the developer unit an AC voltage is superimposed over a DC voltage so that development of the current image formation, accomplished by the DC voltage, occurs at the same time as removal of the residual toner created during the previous image formation, which is accomplished by the AC voltage. When improper feeding of the recording sheet occurs, Hosaka et al. describes applying a reverse bias voltage to the transfer roller while operating the recording machine in an opposite direction, to allow toner that attaches to the transfer roller to return back to the photosensitive drum.

SUMMARY OF THE INVENTION

In accordance with the invention and in accordance with one aspect of the invention, there is provided an improved printing machine of the type having a transfer member associated with a photoconductive member, the transfer member effecting the transfer of a toner image from the photoconductive member. The improvement comprises a blade, movable between a first position contacting the transfer member, and a second position spaced from the transfer member, and a biasing device associated with the transfer member, for selectively applying to the transfer member a bias of a first polarity, or a bias of a second polarity, opposite to the first polarity. The blade accumulates residual material when it is in contact with the transfer member, and is in contact with the transfer member in response to the biasing device applying the bias of the first polarity. The biasing device applies the bias of a second polarity in response to the blade being spaced from the transfer member, so as to attract the accumulated residual material to the photoconductive member.

Pursuant to another aspect of the invention, a transfer apparatus is provided for removal of residual material from a transfer member associated with a photoconductive member, the transfer member effecting the transfer of a toner image from the photoconductive member. The transfer apparatus comprises a blade, movable between a first position contacting the transfer member, and a second position spaced from the transfer member, and a biasing device associated with the transfer member, for selectively applying to the transfer member a bias of a first polarity or a bias of a second polarity, opposite to the first polarity. The blade accumulates residual material when it is in contact with the transfer member, and is in contact with the transfer member in response to the biasing device applying the bias of the first polarity. The biasing device applies the bias of a second polarity in response to the blade being spaced from the transfer member, so as to attract the accumulated residual material to the photoconductive member.

Pursuant to another aspect of the invention, there is provided a method of removing residual material from a transfer member associated with a photoconductive member, the transfer member effecting the transfer of a toner image from the photoconductive member. The method comprises the steps of applying a bias of a first polarity to the transfer member, so that the toner image is transferred from the photoconductive member; moving a blade to a first position in contact with the transfer member, so that residual material is accumulated; moving the blade to a second position, spaced from the transfer member; applying a bias of a second polarity to the transfer member, said second polarity being opposite to the first polarity, so that the accumulated residual material is attracted to the photoconductive member.

DETAILED DESCRIPTION OF THE DRAWINGS

Thus, in FIGS. 1, 2, 4, and 5, exemplary embodiments are illustrated of a transfer support member assembly including a cleaning blade and biasing device, which are representative of the specific subject matter of the present invention.

Figure 1:
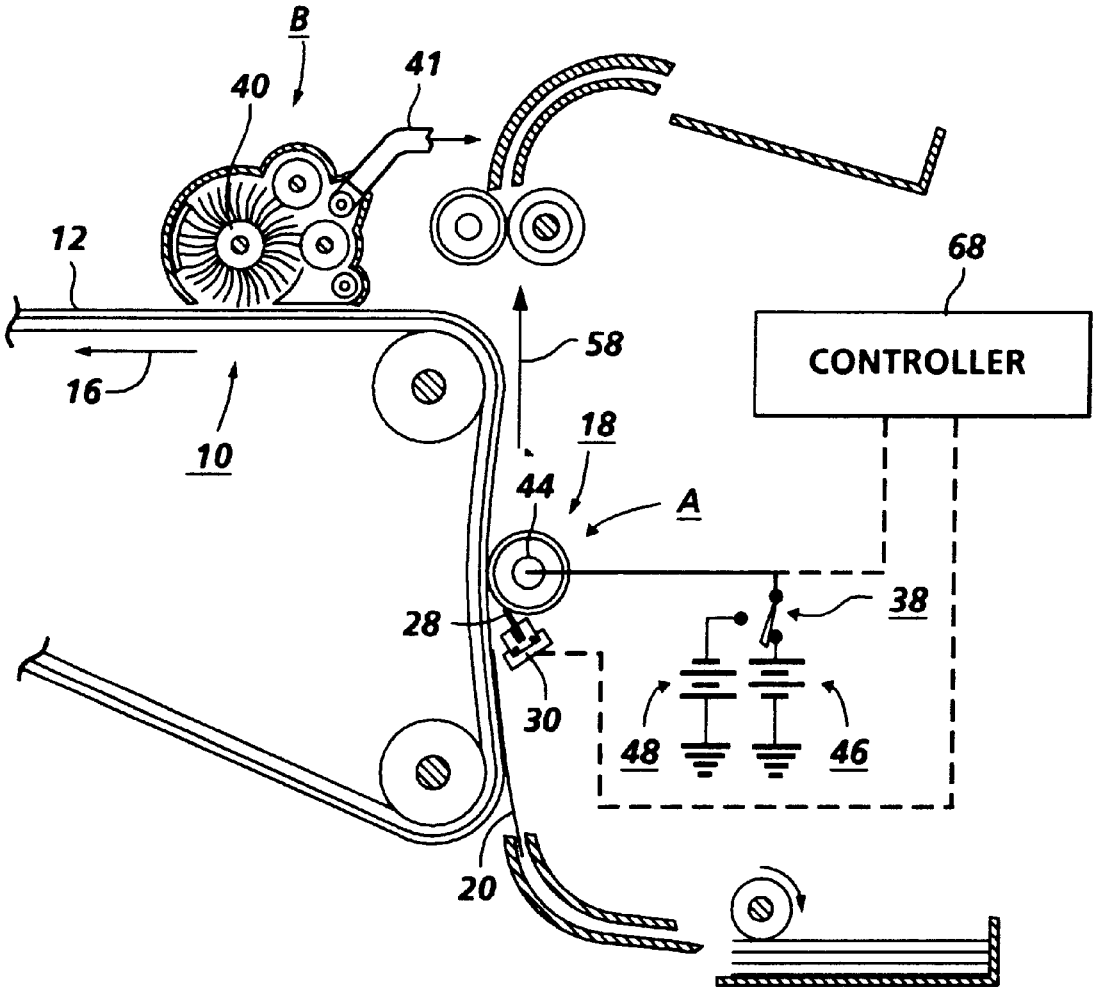
FIG. 1 is a schematic elevational view showing that portion of an electrophotographic printing machine employing the features of one embodiment of the present invention.

FIG. 1 represents one embodiment of the present invention where a bias transfer roll (BTR) 18 serves as the transfer support member at transfer station A. Bias transfer rolls are well known in the art to provide both the bias necessary to induce transfer of the developed toner image from the image bearing photoconductive surface to a copy sheet or support substrate; and to provide support to the copy sheet between the BTR and the photoconductive member during the transfer process.

Figure 2A:
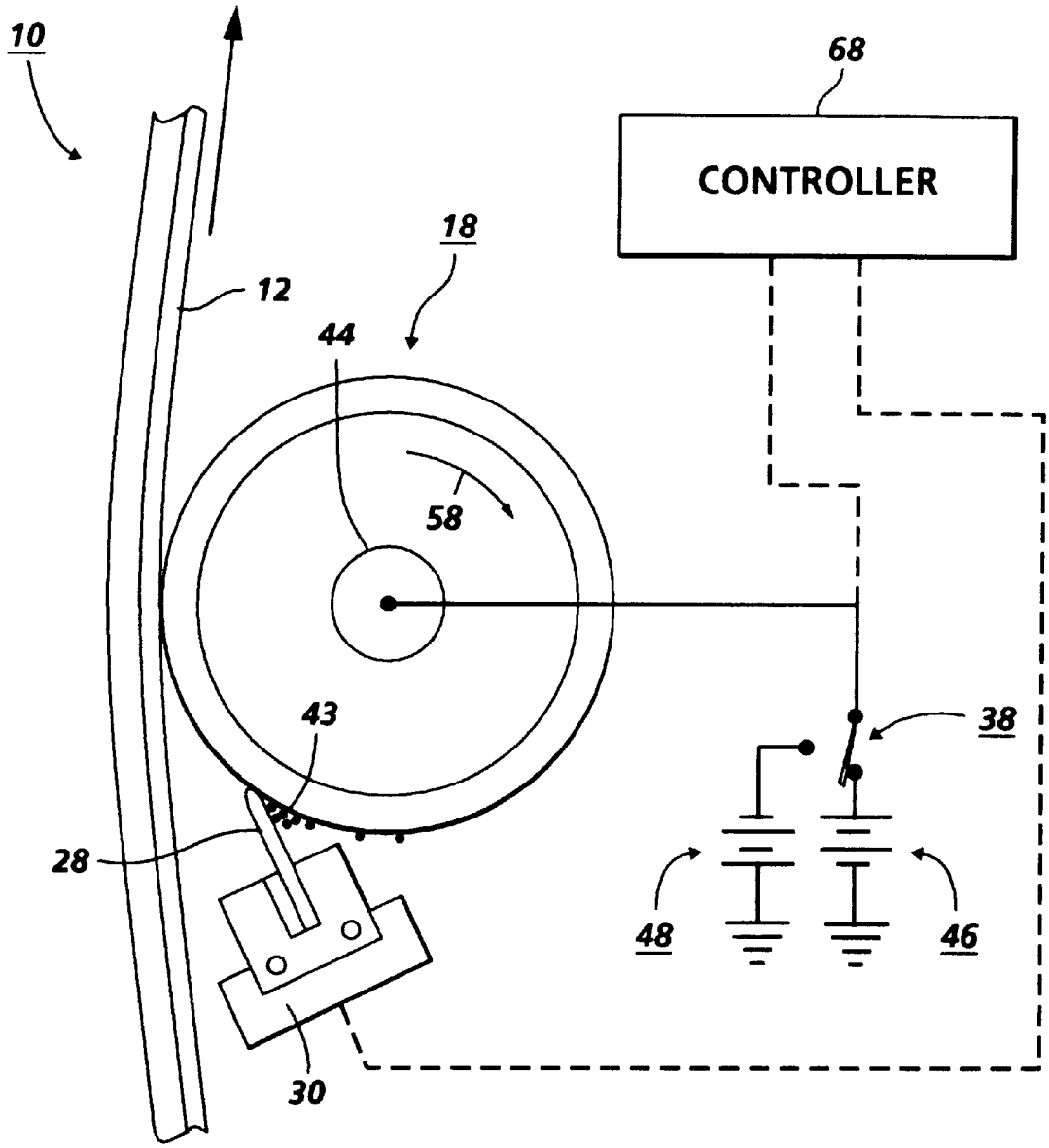
FIGS. 2A–2C illustrate the different modes of operation of the embodiment of the present invention as depicted in FIG. 1.

As illustrated in FIG. 1, an electrical biasing source 46 is provided for generating current through the BTR 18 via switch 38. Switch 38 selectively connects biasing source 46 to the conductive core 44 of roll 18, applying a bias potential to the BTR 18 for creating transfer fields in the transfer nip to induce the transfer of charged toner particles from the photoconductive surface 12 toward the BTR 18. In this condition, the socalled "transfer state", (as shown in FIG. 2A), the transfer roll 18 is biased, preferably to between 1–8Kv D.C., the polarity of which is necessarily opposite that of the charged toner particles such that the charged toner particles will be attracted toward the transfer roll 18. Blade 28 is engaged with the surface of the BTR 18 so that toner and debris adhering to the BTR, residual from transfer process, is collected. Blade cleaning of surfaces used in electrostatographic applications is well known in the art and is described, for example, in U.S. Pat. Nos. 4,561,766, 4,026,648, and 4,989,047.

Figure 2B:
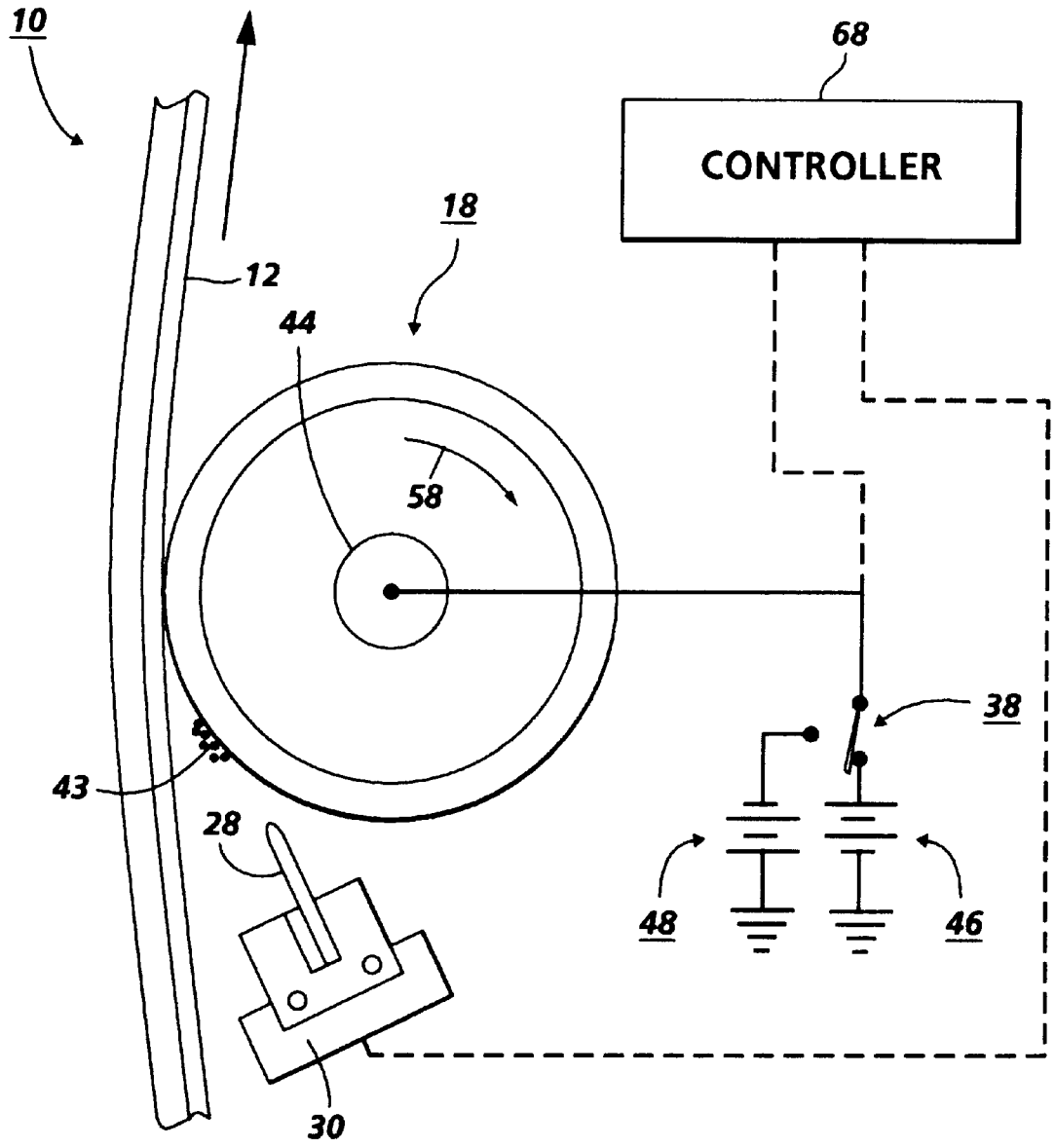
Figure 2C:
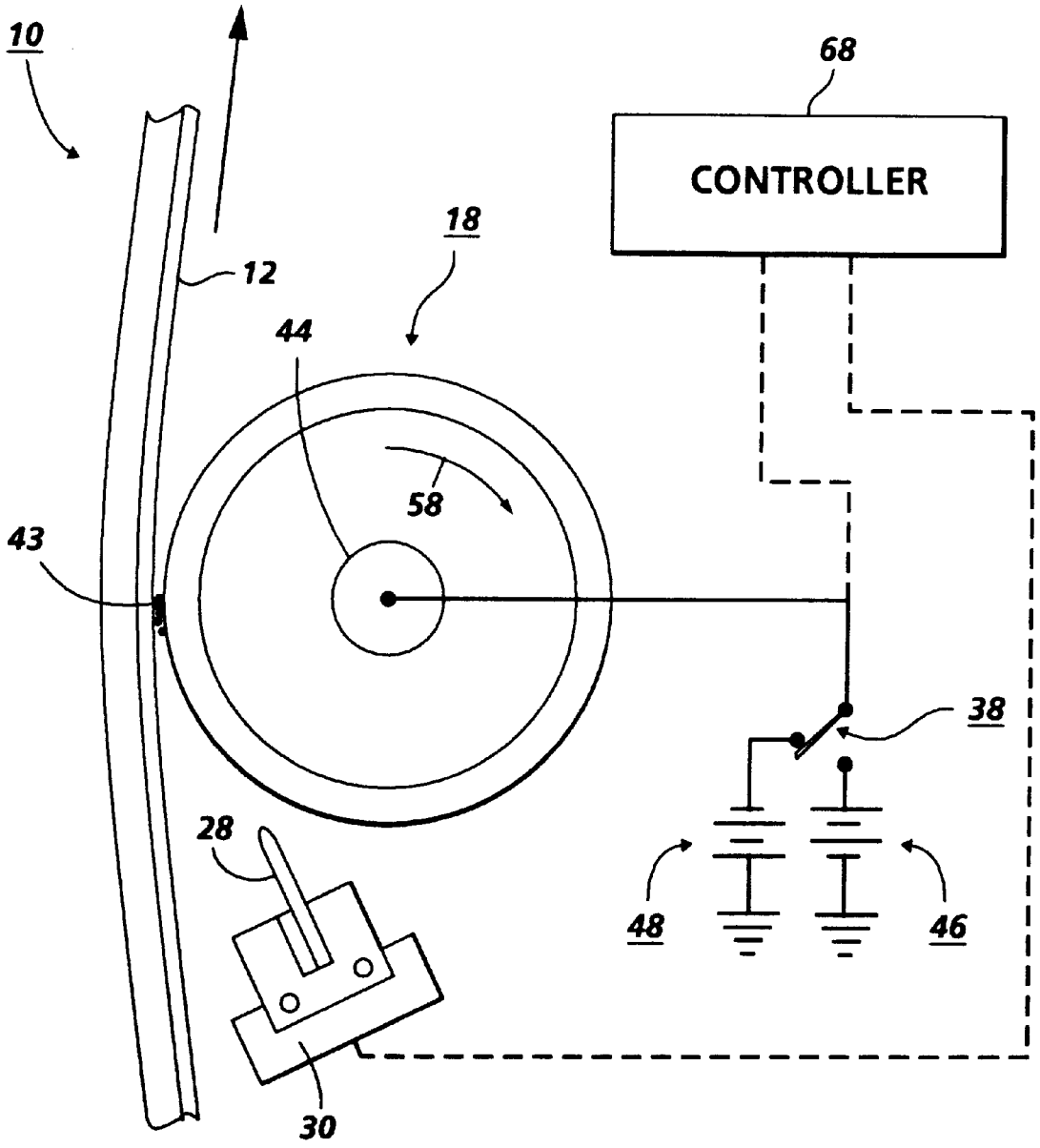

Switch 38 also selectively connects the conductive core 44 of transfer roll 18 to a reverse bias source 48, (as shown in FIG. 2C), in the so-called "retransfer state", whereby current flow through the BTR is reversed. Referring again to FIG. 1, after the copy sheet has passed through the transfer station A, switch 38 selectively couples the conductive core 44 of BTR 18 to a bias voltage source 48 having a polarity opposite that of the bias voltage provided by bias source 46. During the "retransfer state", the blade is disengaged from the surface of BTR. Toner particles adhering to the BTR, collected by blade 28 while engaged with the BTR surface, are then repelled from the BTR surface, and are thereby retransferred to the photoconductive surface 12. Other debris particles on the transfer member may have accumulated with the residual toner, and may also be transferred to the photoconductor during this process. After retransfer to the photoconductive member, these particles are processed through cleaning station B, and are thereby removed from the photoconductive surface in the normal cleaning process.

There is depicted a cleaning brush 40 having a vacuum exhaust duct 41 to carry the residue to storage, as the cleaning means for the photoconductive member. However, it is understood by one skilled in the art that a wide variety of photoconductor cleaning means exist having toner recovery means, any of which could be applicable to the present invention to remove the residual particles which are transferred from the transfer support member.

Referring to FIGS. 2A, 2B, and 2C, controller 68, synchronizes the position of switch 38 (which controls the bias applied to the the BTR), with the appropriate position of the cleaning blade with respect to the transfer support member surface. Controller 68 is shown generally in the form of a microprocessor. Specifically, the controller regulates the bias applied to the BTR and the actuation of blade 28 so that either the BTR is in its "transfer state" and toner is being transferred from the photoconductive surface 12 while the blade 28 is engaged with the BTR surface, as illustrated in FIG. 2A; blade is disengaged from BTR surface as illustrated in FIG. 2B; or the BTR is in its "retransfer state", and toner is retransferred to the photoconductive surface as illustrated in FIG. 2C. Blade 28 is moved from engaged to disengaged position with respect to the transfer support member surface by a blade actuating means 30, which is regulated by controller 68, and which moves blade into and out of contact with the transfer support member surface. It will be appreciated by one skilled in the art that a number of blade actuator means are known in the art, including, but not limited to a switch, cam, spring, gear or any other known mechanical activated or electrical means which could be used to accomplish the novel features of the present invention. An example of a blade actuator of a solenoid assembly type is fully described in U.S. Pat. No. 4,947,214 issued to Baxendell et al., the relevant portions of which are hereby incorporated herein by reference.

Figure 5:
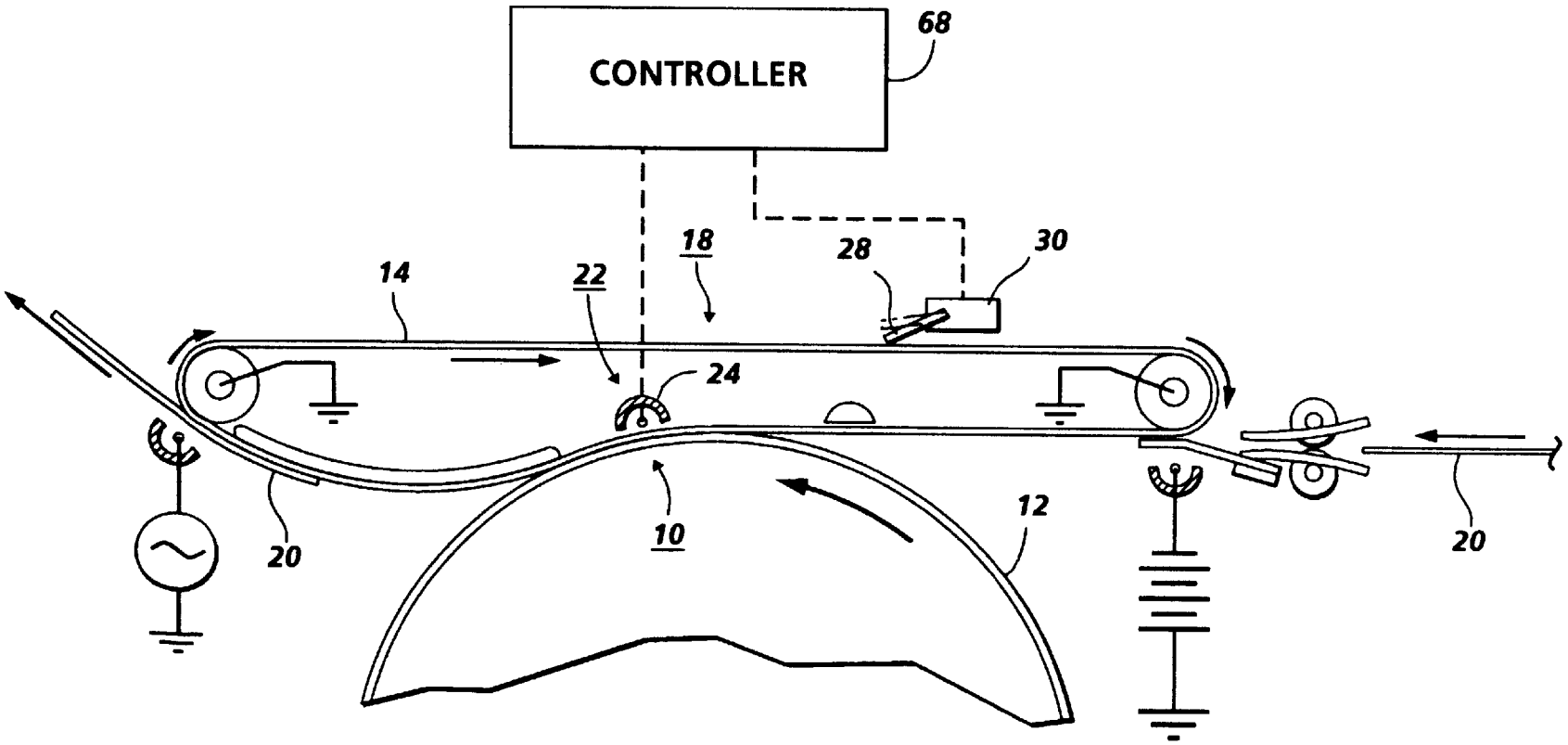
FIG. 5 illustrates another embodiment of the present invention having an electrostatic transport belt as the transfer support member.

In the first described state corresponding to FIG. 2A, microprocessor 68 sends a signal to switch 38 so that a positive voltage bias is applied to the BTR 18 whereby developer of the opposite polarity is attracted and thus transferred from the photoconductive member to a copy sheet. Toner and debris 43 on the BTR surface, residual from the process of transferring the developed image from the photoconductive member to the copy sheet, is collected by blade 28 which is engaged in contact with BTR 18. Blade 28 is shown in the "wiper" mode, where the blade is in a wiping configuration with respect to the rotational direction of the BTR 18. However, it will be understood that the blade could alternatively be positioned in the "doctor" mode, where the blade is in a shearing position with respect to the rotational direction of the transfer support member (as shown in FIG. 5), to accomplish the novel features of the present invention.

In the second state corresponding to FIG. 2B, controller 68 signals the blade actuator 30 so that blade 28 is lifted (disengaged) from the BTR surface, whereby residual toner and debris 43 collected and accumulated by blade 28 travels in rotation on the BTR surface to the point of contact with the photoconductive surface. At this point, as shown in FIG. 2C, controller 68 signals switch 38 to reverse the bias on the BTR, so that the bias repels the residual material 43 adhering to the BTR having the same polarity, thereby attracting and transferring this residual material to the photoconductive surface 12. The controller 68 controls the timing sequence of the reverse bias and blade disengagement steps so that transfer of the residual material to the photoconductor occurs in an interdocument zone or non-image area on the photoconductive member.

Figure 3:
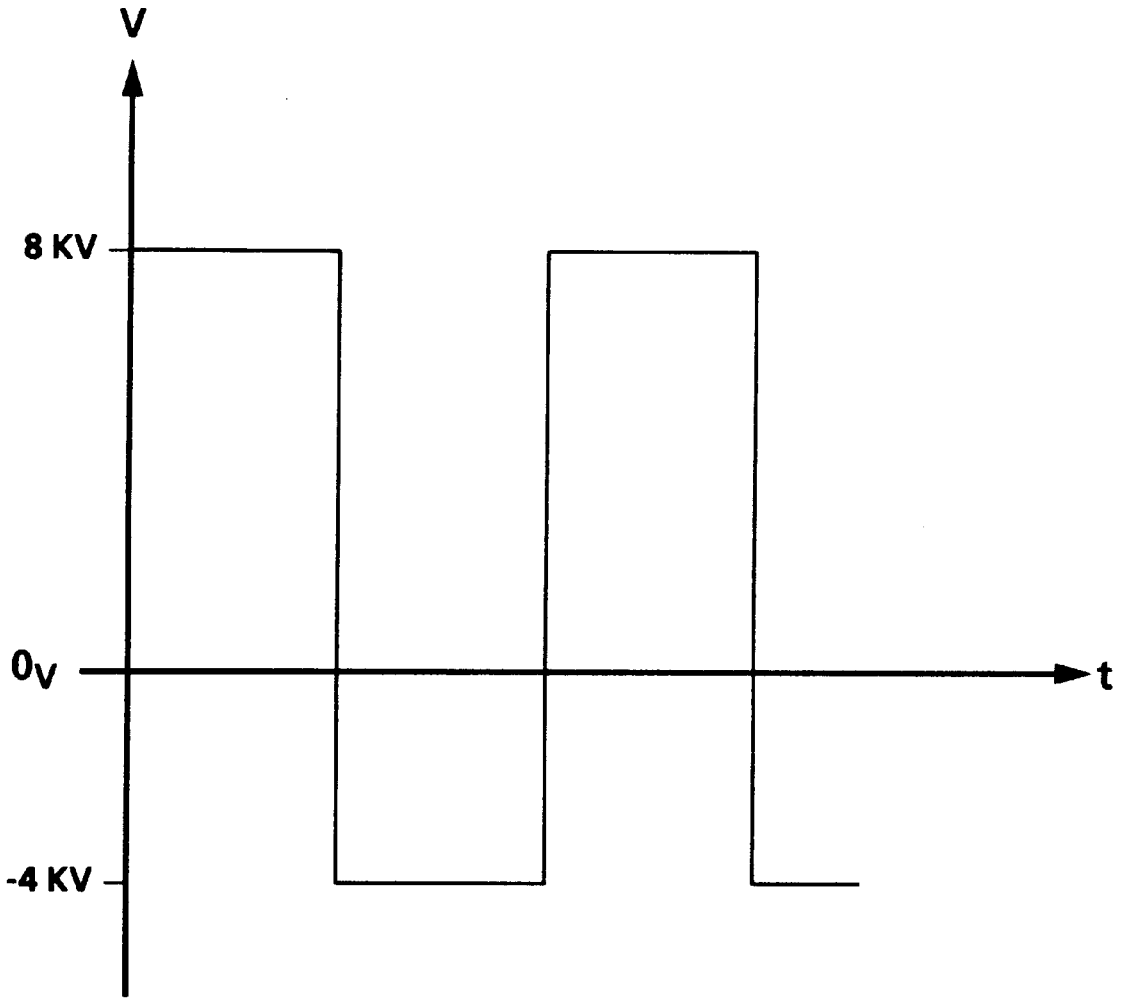
FIG. 3 illustrates a graphical representation of voltage across the bias transfer roll with respect to time during transfer and retransfer periods, according to the embodiment of the present invention as depicted in FIGS. 2A–2C.

The reverse polarity biasing is shown graphically in FIG. 3 wherein an initial bias voltage of approximately 8Kv is applied to the bias transfer roll 18 during the transfer state, while a reverse polarity bias voltage of approximately −4Kv is applied when switch 38 changes to the retransfer state. It is noted that the voltage polarities shown and intimated are described for illustrative purposes only such that the present invention applies equally as well to systems using different polarity scheme. A discussion of the electric fields developed by the bias transfer roll, as well as a detailed description of a preferable circuit for the electrical biasing source are provided in U.S. Pat. No. 3,781,105 issued to Meagher, the relevant portions of which are hereby incorporated herein by reference. A discussion of the switch and reverse biasing source is provided in application for U.S. Pat. Ser. No. 07/801568, filed Dec. 2, 1991, commonly assigned to the assignee herein, the relevant portions of which are hereby incorporated herein by reference.

In the preferred embodiment, and, as indicated in FIGS. 2A–2C,the blade 28 is located in proximity to the bias transfer roll at a point in the process direction 58 of the BTR 18 prior to the point of contact or closest distance between the BTR and the photoconductive member. Thus, after blade 28 is disengaged from the BTR surface and a reverse bias is applied, the accumulated residual particles have a minimal travel distance during transfer to the photoconductive member 10.

Figure 4:
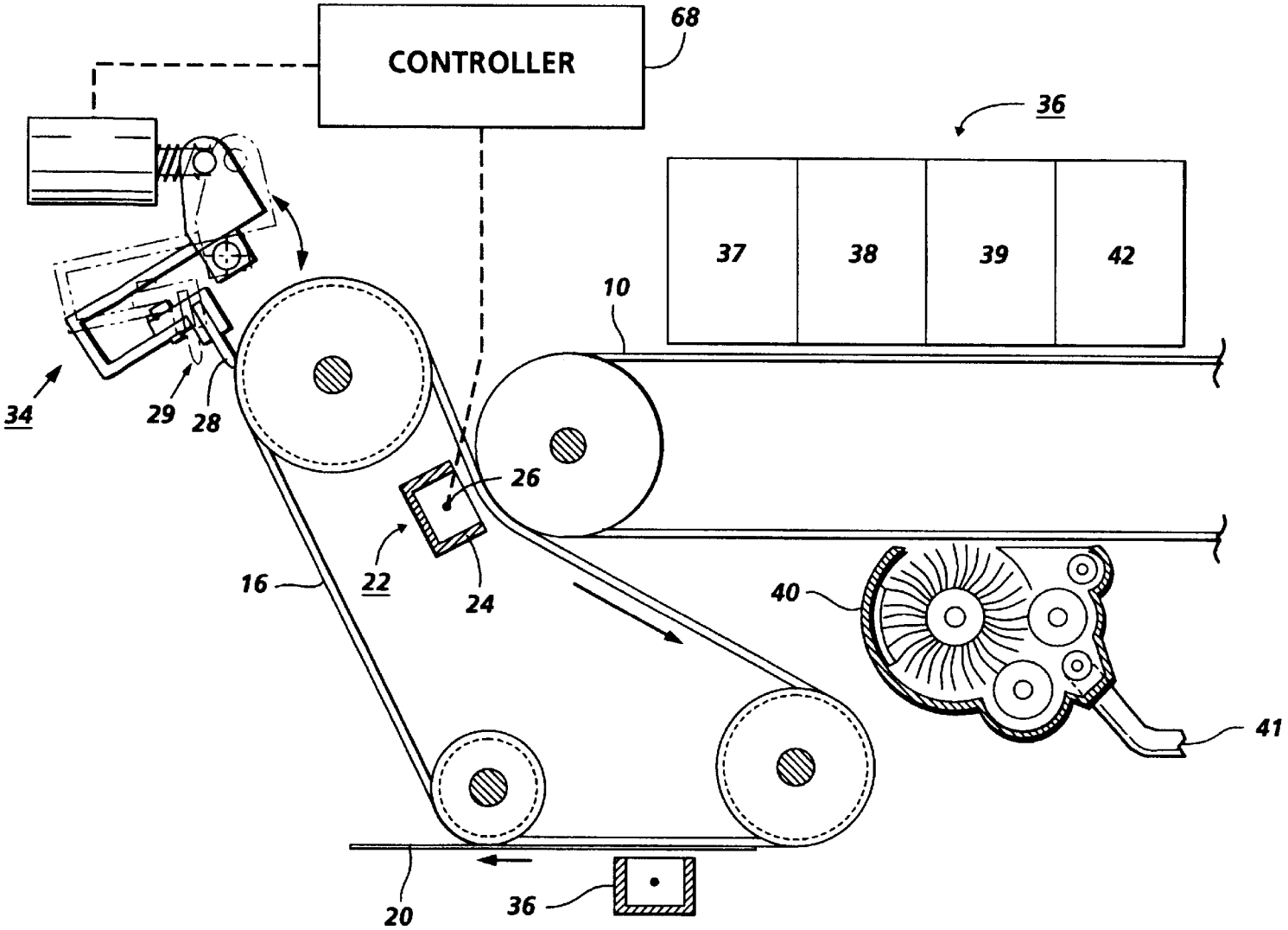
FIG. 4 illustrates another embodiment of the present invention having an intermediate transfer belt as the transfer support member.

FIG. 4 illustrates an alternate embodiment of the present invention wherein an intermediate transfer belt 16 acts as a transfer support member and provides for the final transfer of a full color composite developed image to a sheet 20 in a multiple pass color printing machine. This type of apparatus is described in U.S. Pat. No. 5,237,374, issued to Ueno et al., and is hereby incorporated herein by reference. The transfer belt 16 is pressed in contact with a portion of photoconductive member 10 at transfer station 22, where a corona generating device 24 is positioned for accomplishing transfer of toner powder images from the photoconductive member 10 to the transfer belt 16.

Briefly describing the development and transfer processes of this type of apparatus, a first color latent image, received from exposure station (not shown), is carried by photoconductor drum 10 to the development station 36. Station 36 includes four developer units indicated by the referenced numerals 37, 38, 39 and 42, and which contain toner particles of a specific color (e.g. cyan, magenta, yellow and black). These developer units are of a type generally referred to as "magnetic brush development units". Their operation is described, for example, in U.S. Pat. No. 5,221,948. Liquid color developers may also be used as disclosed in U.S. Pat. No. 4,935,788. The relevant portions of these references are hereby incorporated herein by reference.

A first color toner is supplied by developing unit 37 to the first respective color latent image. The developed image then continues to rotate along the photoconductive member to transfer station 22, where the developed image is transferred by a corona generator 24 onto the intermediate transfer belt 16. Cleaner 40 removes the toner and debris on the photoconductive member, residual from the first color toner transferred image.

The second color toner from developing unit 38 is then developed onto a second respective color latent image received from exposure station. This developed toner powder image then rotates to transfer station 22 where corona generator 24 transfers the toner powder image in superimposed registration onto the first color transferred image. Each respective color toner continues this sequence until each color toner powder image is sequentially transferred at transfer station 22 and superimposed in registration onto the previous color image, to form a full color composite image on the transfer belt. Residual toner remaining on the photoconductive member is removed by cleaning means 40 after each color toner image transfer. A corona generator 36, is arranged for transferring the full color composite image from the transfer belt to a copy sheet 20. Blade 28, having been in disengaged position 29, spaced from the transfer belt surface 16 during the sequential superimposition of each color toner powder image, is engaged with the transfer belt surface after the full color composite image is transferred to sheet 20, in order to clean residual toner and debris particles on the transfer belt.

Thus, controller 68 coordinates the timing sequence of the respective functions of corona generator 24, transfer belt 16, and its associated cleaning blade 28. Specifically, when the respective color toner powder images are sequentially being transferred to the transfer belt, the blade 28 is in disengaged position 29 from the transfer belt surface 16, and coronode wire 26 of corona generator 24 is positively charged so that ions are sprayed onto the bottom side of the transfer belt of an opposite polarity and of a charge sufficient to induce transfer of the charged color toner particles from the photoconductive surface 10 toward the transfer belt 16. After the full color composite image is built up on the transfer belt, it is advanced to corona generator 36 for transfer to sheet 20. Blade 28 then engages the surface of transfer belt 16 for collecting residual particles. Finally, at a predetermined time after transfer of the composite image occurs at transfer station 36 and blade 28 has collected and accumulated residual particles, blade 28 is disengaged from transfer belt surface 16. The accumulated residual particles on transfer belt surface then travel to transfer station 22, at which point the controller applies a negative charge to coronode wire 26 so that ions are generated of a like polarity and of a charge sufficient to repel the particles adhering to the transfer belt surface. These residual particles are then attracted and transferred to the photoconductive member 10. Cleaning station 40 cleans the photo-conductive surface of any residual toner and debris particles, including those residual particles transferred from transfer belt 16. Residue from the cleaning station 40 is then carried from the housing by suction from a vacuum exhaust duct 41 to a storage area (not shown).

Controller 68 coordinates the timing of applying the reverse bias to prevent residual material from the transfer belt from being transferred to an imaging area of the photoconductive member.

An intermediate transfer belt may also be used where the full color composite image is sequentially built by individual color toners on the photoconductive member before being transferred to the transfer belt in a single pass. In this case, photoconductive member cleaning station 40 is inactivated during the formation of the composite image, and then activated following transfer of the composite image to the transfer belt.

The present invention also finds useful application where more than one image forming unit, each having its own photoconductive member, is used in conjunction with a transfer belt. In this type of tandem apparatus, individual color toner images are transferred from each successive photoconductive member to the transfer belt, and are sequentially superimposed onto each previous color image. The composite image formed is then transferred from the transfer belt to a copy sheet. The blade for collecting and accumulating toner and debris particles, residual from the composite image transfer, is located on the intermediate transfer belt in the process direction after the final transfer station and before the first photoconductive member. Released residual particles accumulated by the blade travel on the transfer belt to the first photoconductive member and are attracted to the first photoconductive member when a reverse bias is applied by the biasing device associated therewith. The residual particles then transferred to the first photoconductive member are removed therefrom by the cleaning system associated with the first photoconductive member. A tandem color reproduction apparatus is described in U.S. Pat. No. 5,160,946 to Hwang and is hereby incorporated herein by reference.

An electrostatic transport belt serves as a transfer support member in similar configuration to an intermediate transfer belt in yet another embodiment of the present invention. As shown in FIG. 5, an electrostatic transport belt 18 provides electrostatic tacking for continuously positively retaining a copy sheet 20, including its passage through a transfer station 22, on the moving belt surface 14. After transfer of the developed latent image from photoconductive member 10 to a copy sheet 20 occurs by way of corona generator 24 or other transfer means, residual toner and debris on the EST belt is collected by blade 28, which is positioned in the doctor mode. Alternatively, the blade could be positioned in the wiper mode. The residual toner and debris is then transferred to photoconductive member 10 by applying a reverse bias to corona generator 24 in a timing sequence after blade 28 has been disengaged from surface 14. Controller 68 synchronizes the blade disengagement and reverse bias steps so that transfer of the residual material occurs in a non-image or interdocument zone on photoconductive belt.

I claim:

1. A printing machine of the type having a transfer member associated with a photoconductive member to effect the transfer of a toner image therefrom, comprising:

a blade, movable between a first position, contacting the transfer member, and a second position, spaced from the transfer member, said blade accumulating residual material in the first position; and a biasing device associated with the transfer member, for selectively applying to the transfer member a bias of a first polarity or a bias of a second polarity, opposite to the first polarity, said blade being in the first position in response to said biasing device applying the bias of the first polarity, and the biasing device applying the bias of a second polarity in response to the blade being in the second position, so as to attract the accumulated residual material to the photoconductive member.

2. A printing machine according to claim 1, wherein the transfer member comprises a transfer roll.

3. A printing machine according to claim 2, wherein the biasing device comprises a voltage source coupled to said transfer roll to electrically bias said transfer roll.

4. A printing machine according to claim 2, wherein the toner image is transferred to a sheet positioned between the photoconductive member and said transfer roll.

5. A printing machine according to claim 1, wherein the transfer member comprises an intermediate transfer belt.

6. A printing machine according to claim 5, wherein the biasing device comprises a corona generator adapted to spray ions onto said intermediate transfer belt to electrically bias said intermediate transfer belt.

7. A printing machine according to claim 5, wherein the toner image is transferred to said intermediate transfer belt.

8. A printing machine according to claim 7 wherein the toner image is transferred from said intermediate transfer belt to a sheet.

9. A printing machine according to claim 1, wherein said transfer member comprises an electrostatic transport belt.

10. A printing machine according to claim 9, wherein the biasing device comprises a corona generator adapted to spray ions onto said electrostatic transport belt to electrically bias said electrostatic transport belt.

11. A printing machine according to claim 9, wherein the toner image is transferred to a sheet positioned between the photoconductive member and the electrostatic transport belt.

12. A printing machine according to claim 1, further comprising a cleaning system for removing from the photoconductive member residual material attracted thereto.

13. A printing machine according to claim 1, wherein the accumulated residual material is attracted to the photoconductive member in a non-image area.

14. A transfer apparatus in which residual material on a transfer member is removed to a photoconductive member, comprising:

a blade, movable between a first position, contacting the transfer member, and a second position, spaced from the transfer member, said blade accumulating residual material in the first position; and a biasing device associated with the transfer member, for selectively applying to the transfer member a bias of a first polarity or a bias of a second polarity, opposite to the first polarity, said blade being in the first position in response to said biasing device applying the bias of the first polarity, and the biasing device applying the bias of the second polarity in response to the blade being in the second position so as to attract the accumulated residual material to the photoconductive member.

15. A transfer apparatus according to claim 14, wherein the transfer member comprises a transfer roll.

16. A transfer apparatus according to claim 15, wherein the biasing device comprises a voltage source coupled to said transfer roll to electrically bias said transfer roll.

17. A transfer apparatus according to claim 15, wherein the toner image is transferred to a sheet positioned between the photoconductive member and said transfer roll.

18. A transfer apparatus according to claim 14, wherein the transfer member comprises an intermediate transfer belt.

19. A transfer apparatus according to claim 18, wherein the biasing device comprises a corona generator adapted to spray ions onto said intermediate transfer belt to electrically bias said intermediate transfer belt.

20. A transfer apparatus according to claim 18, wherein the toner image is transferred to said intermediate transfer belt.

21. A transfer apparatus according to claim 20, wherein the toner image is transferred from said intermediate transfer belt to a sheet.

22. A transfer apparatus according to claim 14, wherein said transfer member comprises an electrostatic transport belt.

23. A transfer apparatus according to claim 22, wherein the biasing device comprises a corona generator adapted to spray ions onto said electrostatic transport belt to electrically bias said electrostatic transport belt.

24. A transfer apparatus according to claim 22, wherein the toner image is transferred to a sheet positioned between the photoconductive member and the electrostatic transport belt.

25. A transfer apparatus according to claim 14, further comprising a cleaning system for removing from the photoconductive member residual material attracted thereto.

26. A transfer apparatus according to claim 14, wherein the accumulated residual material is attracted to the photoconductive member in a non-image area.

27. A method of removing residual material from a transfer member to a photoconductive member, comprising the steps of:

moving a blade between a first position, contacting the transfer member, and a second position, spaced from the transfer member, selectively biasing the transfer member to a bias of a first polarity or a bias of a second polarity, opposite to the first polarity, moving the blade to the first position in response to biasing the transfer member to the bias of the first polarity, accumulating residual material when the blade is in the first position, biasing the transfer member to the second polarity in response to the blade being in the second position, attracting the accumulated residual material to the photoconductive member when the bias of the second polarity is applied to the transfer member.

28. A method according to claim 27, further comprising the step of transferring a toner image from the photoconductive member to the transfer member.

29. A method according to claim 27, further comprising the step of removing the attracted residual material from the photoconductive member with a cleaning system.

30. A method according to claim 27, further comprising the step of transferring the accumulated residual material to the photoconductive member in a non-image area.

31. A method according to claim 27, wherein: the biasing the transfer member of the first polarity step, and the biasing the transfer member of the second polarity step, further comprise the step of spraying ions onto the transfer member with a corona generator.

32. A method according to claim 27, wherein: the biasing the transfer member of the first polarity step, and the biasing the transfer member of the second polarity step, further comprise the step of generating an electric field with a transfer roll.

33. A method according to claim 32, wherein: the biasing the transfer member of the first polarity step, and the biasing the transfer member of the second polarity step, further comprise the step of electrically biasing said transfer roll with a voltage source coupled to said transfer roll.

34. A method according to claim 32, further comprising the step of transferring a toner image onto a sheet positioned between the photoconductive member and the transfer roll.

* * * * *